United States Patent [19]

Niemiec

[11] Patent Number: 4,731,999

[45] Date of Patent: Mar. 22, 1988

[54] POWER TRANSMISSION

[75] Inventor: Albin J. Niemiec, Sterling Heights, Mich.

[73] Assignee: Vickers, Incorporated, Troy, Mich.

[21] Appl. No.: 42,286

[22] Filed: Apr. 24, 1987

[51] Int. Cl.[4] ..... F16D 31/02

[52] U.S. Cl. ..... 60/468; 60/494; 417/295; 417/307

[58] Field of Search ..... 60/459, 468, 494; 417/295, 307, 311

[56] References Cited

U.S. PATENT DOCUMENTS 3,449,911 6/1969 Schlosser ..... 417/295

3,978,666 9/1976 Kelley et al. ..... 60/468

*Primary Examiner*—Robert E. Garrett

*Assistant Examiner*—Therese Newholm

*Attorney, Agent, or Firm*—Barnes, Kisselle, Raisch, Choate, Whittemore & Hulbert

[57] ABSTRACT

A hydraulic system comprised of a pump, a first valve in the inlet to the pump, and a second valve which activates or deactivates a third valve which permits the loading and unloading of the pump discharge. A motor is provided to operate the first valve for opening or closing the pump inlet. This motor also actuates the second valve in concert with the operation of the first valve to open or close a vent port to the third valve which opens or closes the passage from the pump discharge to tank, located away from the pump inlet. This permits unloading the pump discharge during the restriction of the pump inlet and allows the loading of the pump discharge after the opening of the pump inlet. With the pump inlet restricted, the system provides a low restrictive passage for circulating the prescribed small volume of flow used to lubricate and cool the pump.

14 Claims, 10 Drawing Figures

25
27
15a
18a
38
34
24a
23a
29
22b
17a
39
28
28
33
36
20a
22a
40
38
26
35
37
45
47
46
48
53
49
M
52
50
51
V 25
27
15a 22b
18a
38
34
24a
29
28
17a
28
33
36
20a
22a
26
38
35
40
37
45
47
46
48
49
53
51
52
50

POWER TRANSMISSION

This invention relates to hydraulic circuits utilizing a pump and a valve which restricts the flow to the pump inlet for unloading the pump when there is a load or there is not a load on the hydraulic circuit.

BACKGROUND AND SUMMARY OF INVENTION

It has heretofore been suggested that substantial savings in energy can be achieved when there is no load on a pump by utilizing a valve which closes the pump inlet, except for a small opening to admit a prescribed small volume of fluid to lubricate and cool the pump. Such a valve is commonly known as a dry valve or a cruise valve and is described, for example, in U.S. Pat. Nos. 2,118,180 and 3,935,917.

In such a hydraulic circuit, if the valve at the pump inlet is closed when the hydraulic system is loaded, the resulting sudden decompression of the pressurized volume and the ensuring cavitation will cause damage to the pump. In addition, the noise attributed to cavitation is extremely loud and usually intolerable. In addition, in such a hydraulic system, it is necessary that when the valve is closed, the amount of flow permitted to enter the pump and its pressure be controlled to certain minimum limits so as to reduce the conditions for cavitation while the pump is operating. If this amount of lubricating/cooling flow and its pressure exceed a certain minimum, the pump will operate with noticeable cavitation.

Accordingly, among the objectives of this invention are to provide a hydraulic system wherein excessive cavitation due to unloading the pump when the hydraulic system is loaded is obviated; wherever the amount of hydraulic fluid which is permitted to pass through the pump when the dry valve is closed is controlled to reduce cavitation and to prevent high levels of noise; and wherein the pressure of the fluid which is circulated through the pump when the valve is closed is controlled to assure quiet operation.

In accordance with the invention, a hydraulic system comprises a pump, a first valve in the inlet of the pump, a second valve which activates or deactivates a third valve which permits the loading and unloading of the pump discharge. A motor is provided to operate the first valve for opening or closing the pump inlet. This motor also actuates the second valve in concert with the operation of the first valve to open or close the vent portion to the third valve which opens or closes the passage from the pump discharge to tank, away from the pump inlet. This permits unloading the pump discharge during the restriction of the pump inlet and for allowing the loading of the pump discharge after the opening of the pump inlet. With the pump inlet restricted, the system provides a low restrictive passage for circulating the prescribed small volume of flow used to lubricate and cool the pump.

DESCRIPTION

Figure 1:
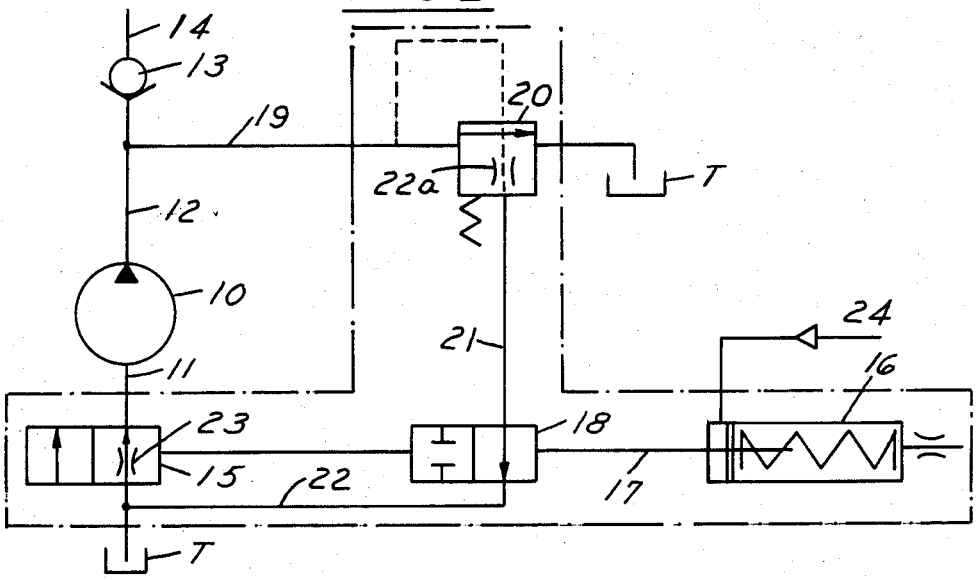
FIGS. 1, 2 and 2*a* are schematic diagrams showing the hydraulic system in different operative positions.

Referring to FIG. 1 which is a schematic of a hydraulic system embodying the invention, the hydraulic system comprises a hydraulic pump 10, which may be of various types such as a vane pump, piston pump, gear pump or the like, having an inlet 11 and an outlet 12 extending through a unidirectional valve 13 to a load line 14. A normally-closed valve 15 is provided at the inlet and is operated by a motor 16, such as a pneumatic motor, through a shaft 17 to move the valve 15 from a normally-restricted position to an open position corresponding to a no load and load on the system, respectively. A normally open vent valve 18 is also operated by shaft 17. A fluid line 19 extends from outlet 12 to a normally closed unloading valve 20. A line 21 extends from unloading valve 20 to vent valve 18. An internal bypass 20*a* and restrictor 22*a* are provided within unloading valve 20 so that there is restricted communications between lines 19 and 21 even when the unloading valve 20 is closed. A line 22 extends from vent valve 18 to inlet valve 15 so that when vent valve is opened, fluid will flow through line 19, restrictor 22*a* and lines 21, 22, mix with the cooler volume of fluid from reservoir or tank T and enter the pump through a restrictor 23 in valve 15. This fluid cools and lubricates the pump even though inlet valve is closed. Restrictor 23 may be in the form of clearance in valve 15 or a restricted passage or both.

Figure 2:
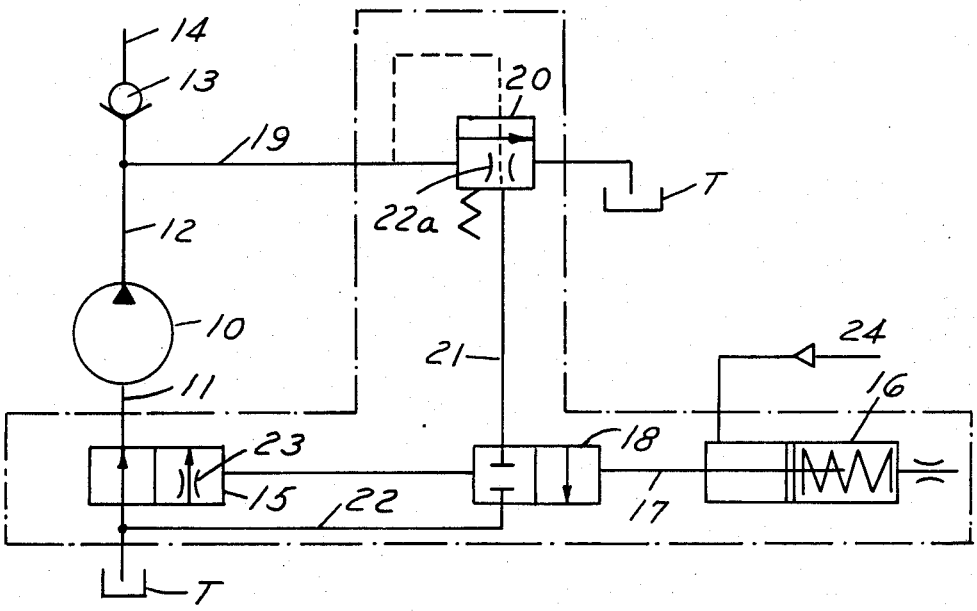

Referring to FIG. 2 when the hydraulic system is to be operated and there is no load on the system, air from a line 24 operates the motor 16 to open the valve 15 permitting the full flow of fluid through the inlet line 11 to the pump 10 and, in turn, to the discharge line 12 and unidirectional valve 13 to the load line 14. Simultaneously, the valve 18 is closed preventing flow through restrictor 22*a* and line 21. Since there will be no pressure drop across valve, the spring of unloading valve 20 will maintain the valve 20 in closed position.

Figure 2A:
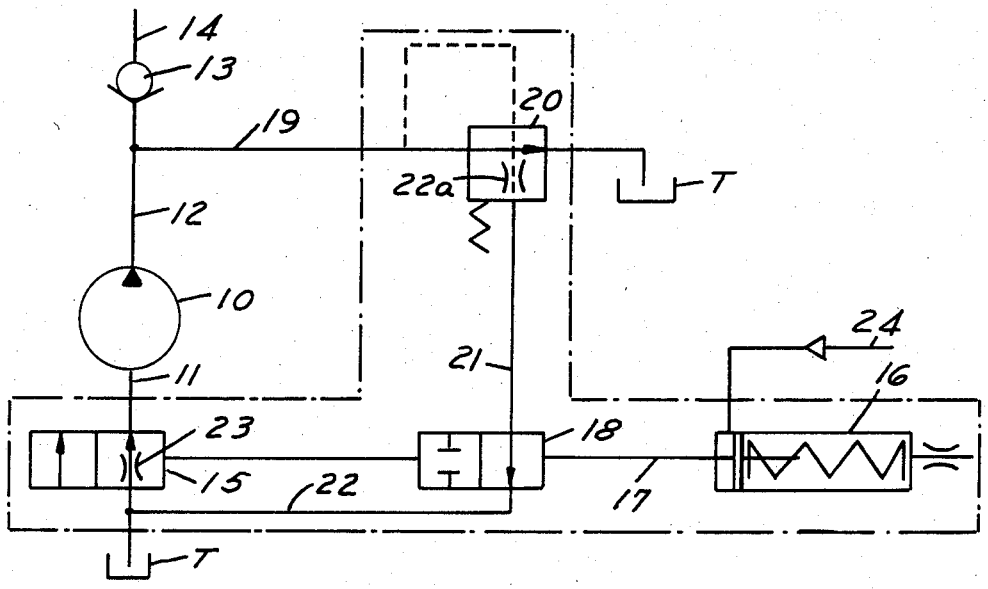

If the motor 16 is operated to close the valve 15 when there is a load on outlet 12, initially, the vent valve 18 will be moved to open position, as shown in FIG. 2*a*, before the inlet valve 15 is completely closed. This will vent the line 21 to tank so that the system pressure in line 19 will provide a pressure differential across unloading valve 20 to open valve 20. The opening of unloading valve 20 permits the fluid to flow to the reservoir and thereby immediately unloads the pressure in line 19 thereby avoiding the excessive cavitation that would result in the operation of the pump with no fluid provided thereto and, in turn, the possible damage to the pump.

Figure 3:
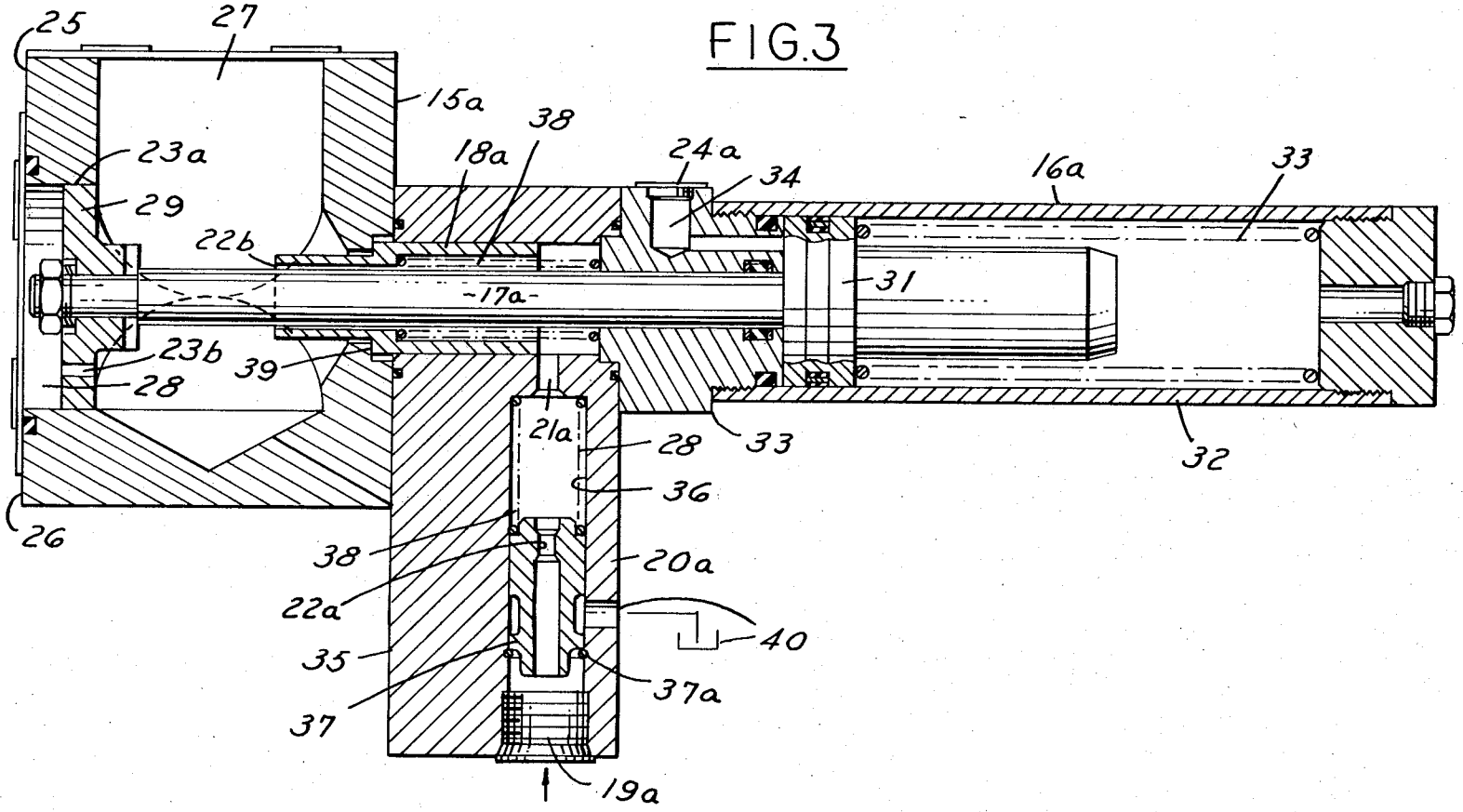
FIG. 3 is a longitudinal sectional view of a valve arrangement utilized with the pump.

Referring to FIG. 3, in a preferred embodiment, the valve 15, motor 16, vent valve 18 and unloading valve 20 are preferably provided in a single unit, shown schematically in broken lines in FIGS. 1 and 2. For purposes of clarity, these common units are designated with the suffix a. As shown in FIG. 3, the valve 15*a* includes a body 25 which has a surface 26 adapted to be mounted adjacent the inlet of a pump. The valve further includes an inlet opening 27 and an inlet passage 28 extending to the inlet of the pump. A piston valve element 29 is provided in the passage 28 and functions to substantially close the flow in the normally-closed position except for a small clearance as at 23*a* permitting fluid to flow into the pump for lubrication and cooling. An orifice 23*b* in element 29 can be used to supplement the clearance. Valve element 29 is mounted on a shaft 17*a* fixed to a piston 31 operating within a cylinder 32 of motor 16*a* and yieldingly urged by a spring 33 to the left as viewed in FIG. 3, to close the inlet passage 28. Cylinder 32 includes a head 32*a* having a passage 34 extending to one side of the piston 31 to which air is supplied through the line 24A for moving the piston to the right as viewed in FIG. 4.

The unloading valve 20*a* comprises a body 35 having a bore 36 in which a valve 37 is positioned and yieldingly urged by a spring 38 downwardly against a stop 37*a* as viewed in FIG. 3. Valve 37 includes a sized passage 22*a* that functions to provide a less restricted passage for the lubrication/cooling flow when the valve 15*a* is in closed position and provide a pressure drop to position valve 37 to unload the pump displaced fluid to tank when valve 15*a* starts to open the pump inlet. The vent valve 18*a* is in the form of a tube surrounding the shaft 17*a* and yieldingly urged by a spring 38 to the left as viewed in FIG. 3 against a shoulder 39 in the body 25. The tubular valve 18*a* is spaced from the shaft 17*a* to define a space 22*b* which together with passage 21*a* defines a line to tank or reservoir. Flow through valve element 37 passages from line 19*a* through passage 22*a*, passages 21*a* and 21*b* to mix with the fluid from the reservoir for lubricating and cooling the pump. Unloading valve 20*a* also provides a means for decompressing the discharged volume prior to closing of the pump inlet of valve 15*a*. A valve 18*a* opens vent port 21*a*, valve 20*a* opens and directs the pump discharge to reservoir T away from the pump inlet. When valve 15*a* closes the pump inlet, there is insufficient flow to keep valve 20 open and valve 37 will return to closed position. In the closed position, the passages in valve 20 are sufficient for cooling and lubrication flow to pass without affecting the internal pressure balance.

Figure 4:
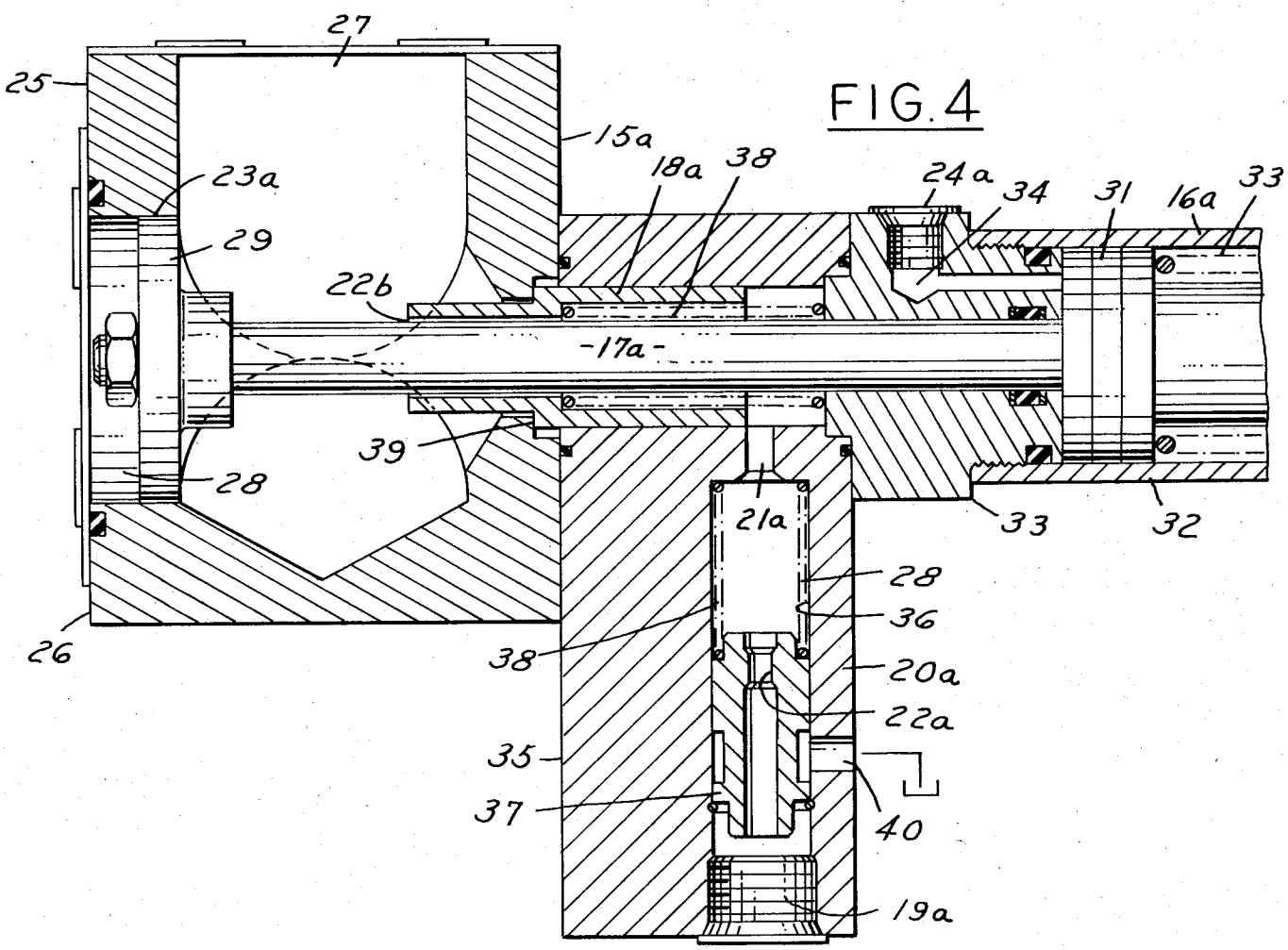
FIG. 4 is a fragmentary sectional view on an enlarged scale of a portion of the valve arrangement shown in FIG. 3.
Figure 5:
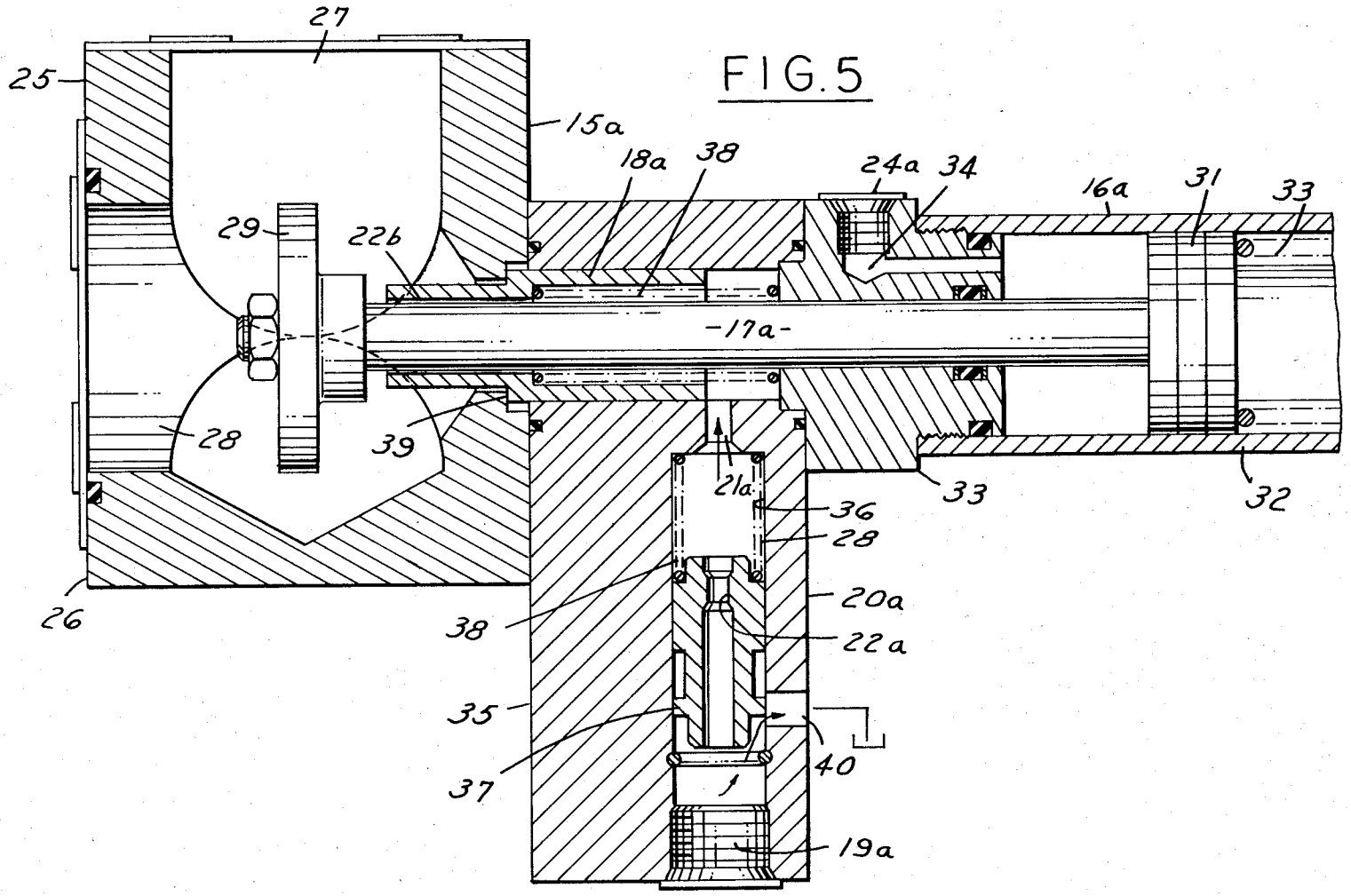
FIG. 5 is a view similar to FIG. 4 showing the valve arrangement in a different operative position.
Figure 6:
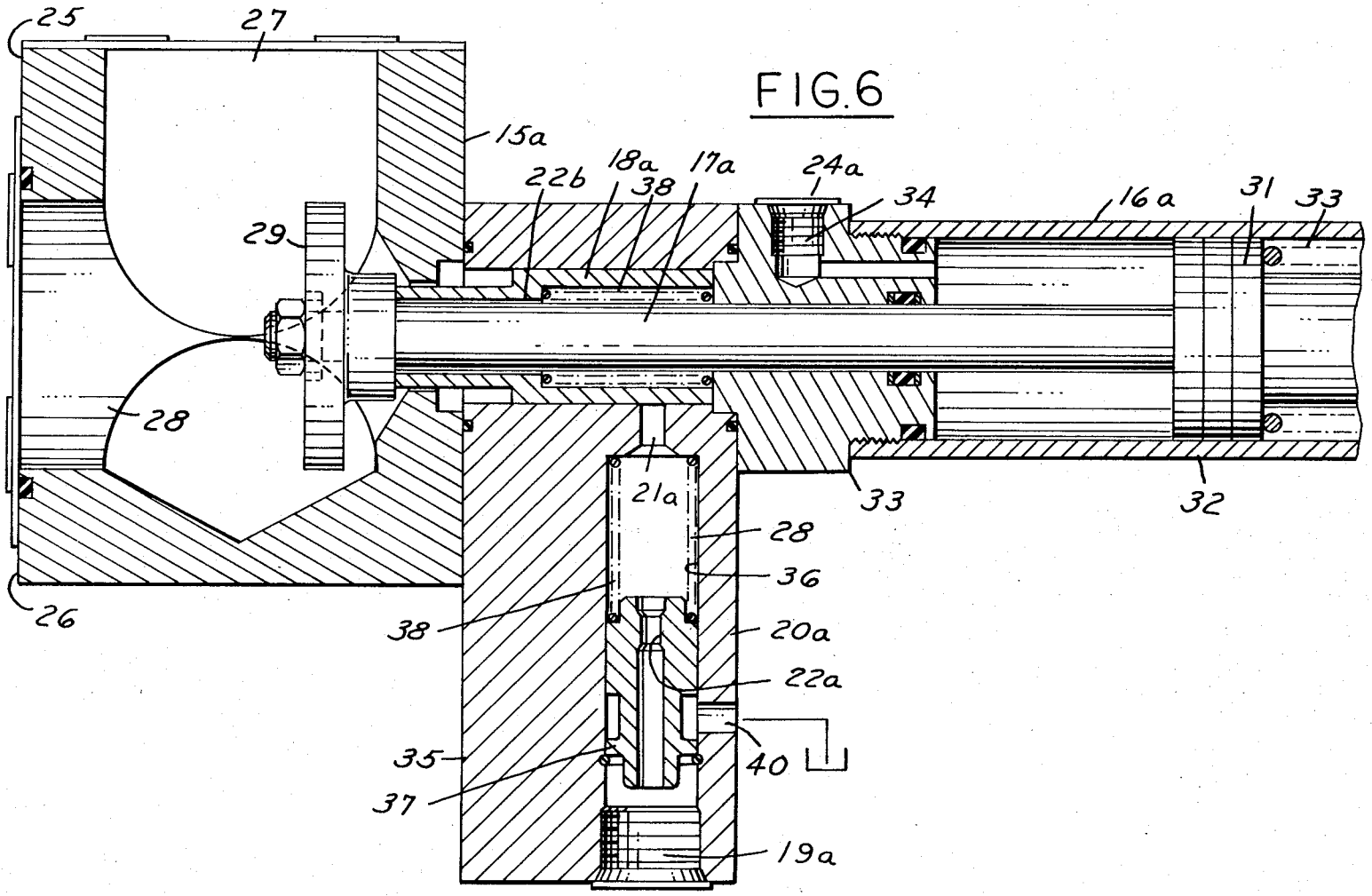
FIG. 6 is a view similar to FIG. 4 showing the valve arrangement in a different operative position.

In the normally closed position shown in FIG. 4 on an enlarged scale, fluid is not permitted to flow to the pump except for a small portion of fluid through the clearance 23*a* and/or orifice 23*a* for lubrication and cooling. When the motor 16*a* is actuated the valve element 29 is moved to the right, as viewed in FIG. 6, permitting the fluid to flow to the inlet of the pump. In this position, the vent valve 18*a* is moved to close the passage 21*a*. Referring to FIG. 5, if the motor 16*a* is operated to open the valve 15 while there is a load on the system, initially the piston 29 will move to a partially open position shown in FIG. 5. Any initial increased pump discharge will follow the route of the lubricating and cooling flow through lines 19*a*, restrictor 22*a*, line 21*a* and space 22*b*, valve 20 and valve 18. Because of the increased flow and the size of passage 22*a*, the resulting pressure difference will cause valve spool 37 to act against the spring 28 and open the tank passage for bypassing the increased discharge volume until the motor 16 completes its motion and closes valve 15*a*. After this, the entire pump discharge is available for doing work in the hydraulic system. In the absence of valve 20*a*, the increased flow would enter valve 18*a* and create a large pressure drop across valve 18*a* due to the restricted flow through valve 18*a*. Such large pressure drop would inhibit the closing of valve 18*a* by motor 16*a*. During this normal operation, the valve 29 is permitted to move to a closed position, the vent valve 18 is returned to the position shown in FIG. 4 and the unloading valve 20*a* functions to unload line 19 to prevent pressure build-up in the pump discharge and to prevent cavitation damage to the pump.

It can thus be seen that there has been provided a hydraulic system wherein excessive cavitation due to unloading the pump when the hydraulic system is still loaded is obviated; wherein the amount of hydraulic fluid which is permitted to pass through the pump when the dry valve is closed is controlled to prevent high levels of noise; and wherein the pressure of fluid which is circulated through the pump when the valve is closed is controlled to assure quiet operation.

Figure 7:
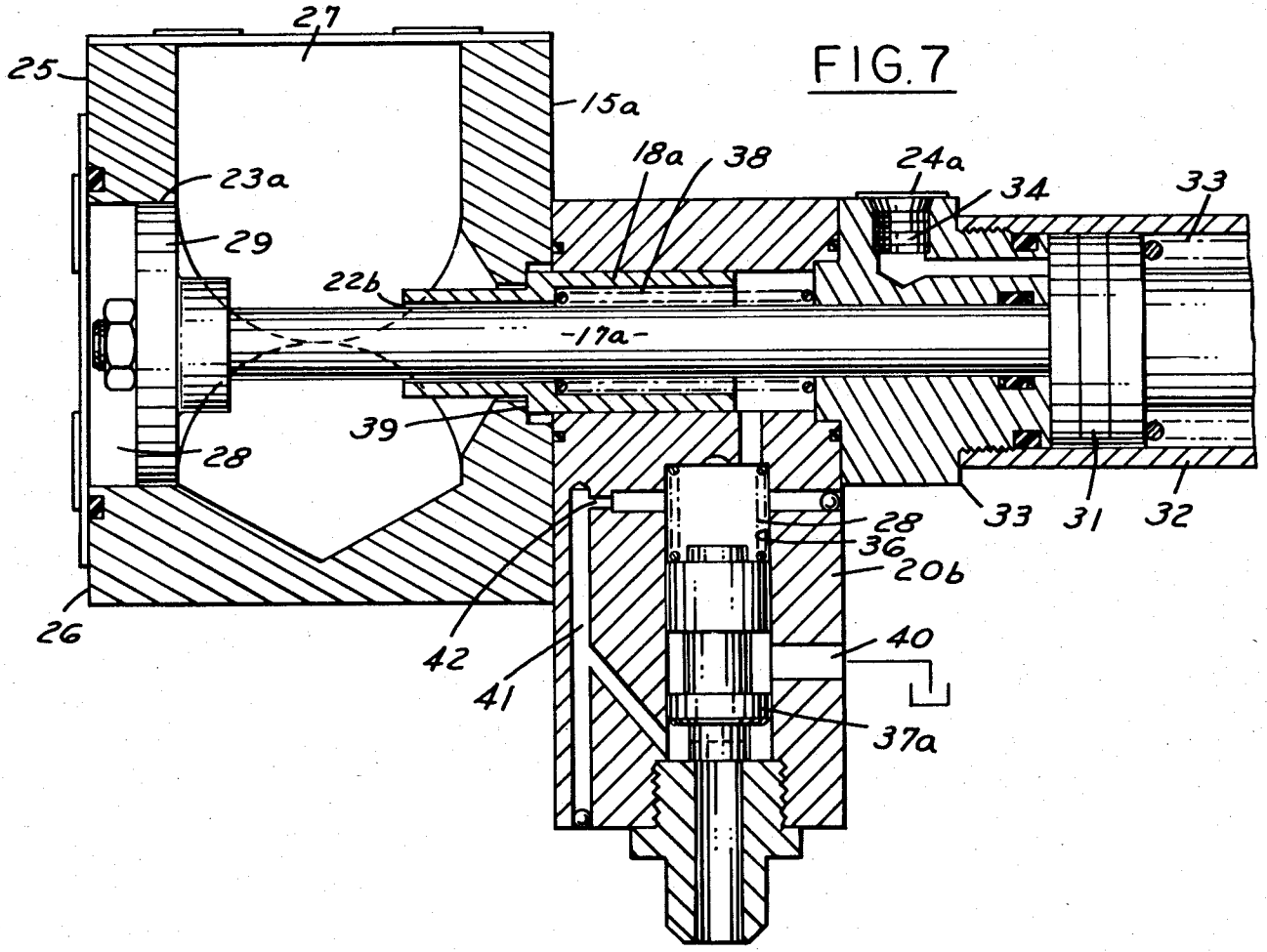
FIG. 7 is a fragmentary sectional view of a modified form of valve arrangement.

In the modified form shown in FIG. 7, instead of having a bore 22*a* in the valve element 37, as in FIG. 3, the valve body 20*b* is formed with a bypass passageway 41 in the valve body extending between opposite ends of said valve element 37 having a restriction 42 therein which functions in the same manner as passage 22*a*.

Figure 8:
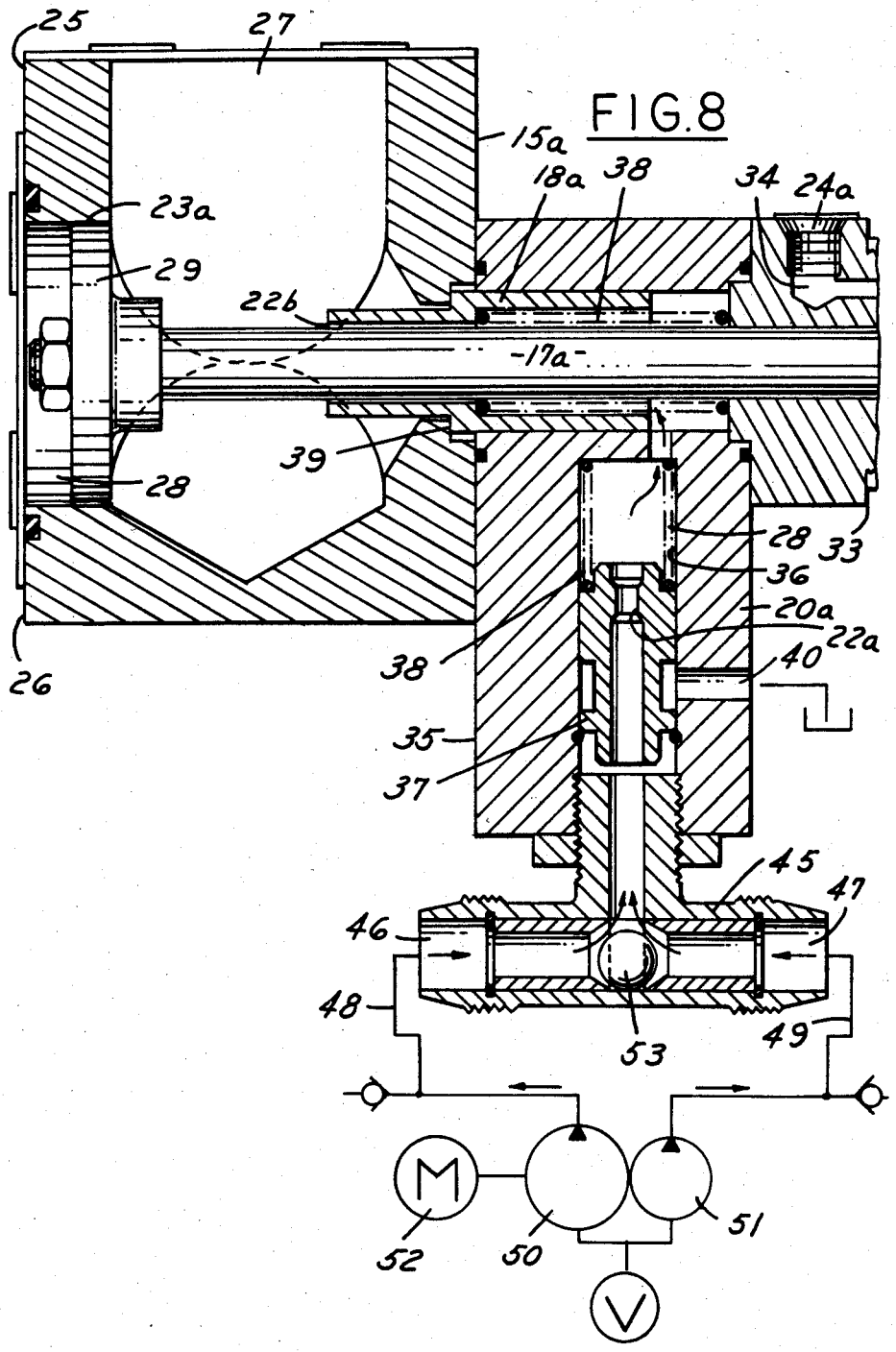
FIG. 8 is a fragmentary sectional view of a modified hydraulic system.
Figure 9:
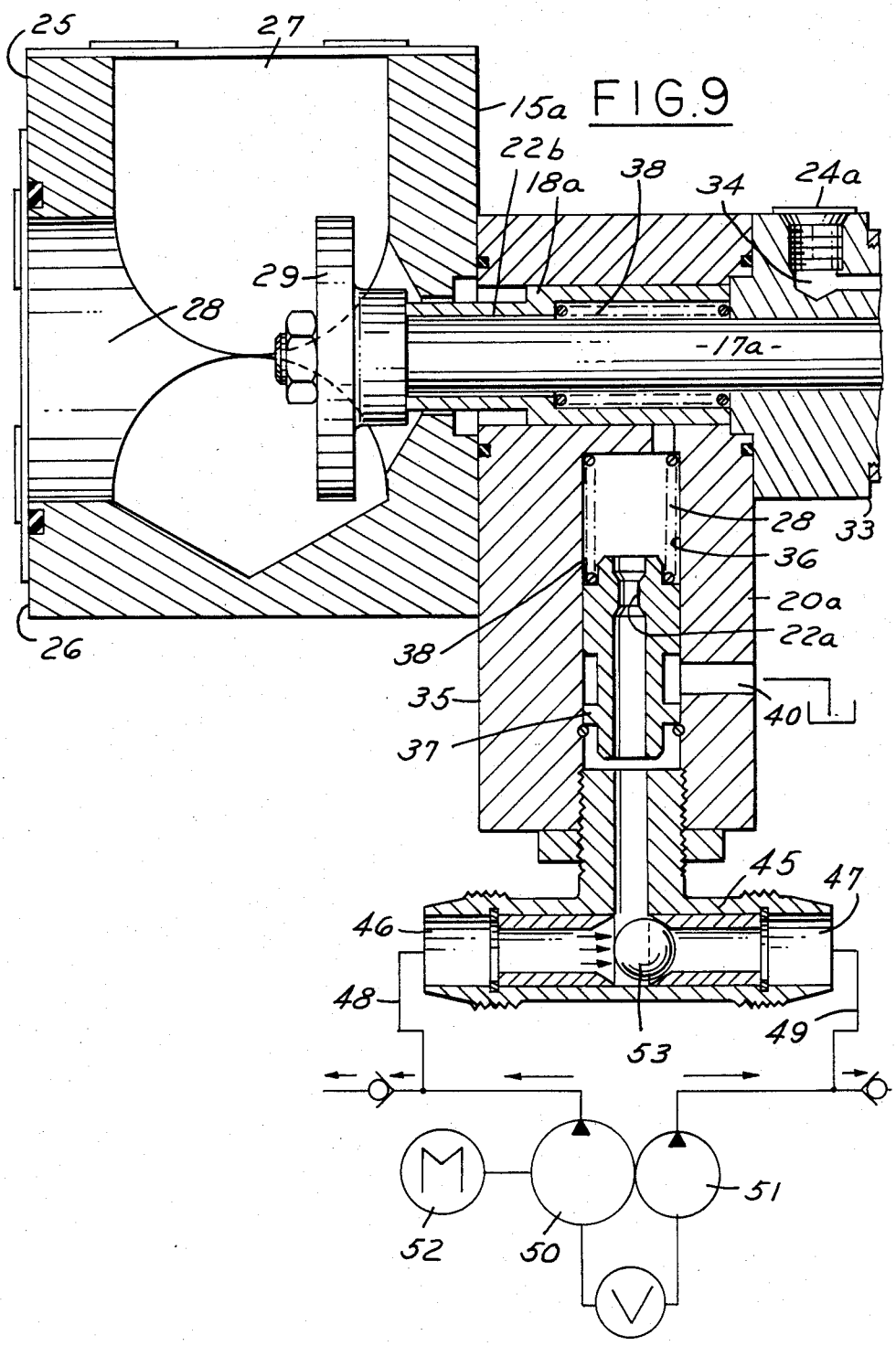
FIG. 9 is a fragmentary sectional view similar to FIG. 8 in a different operative position.

Referring to FIGS. 8 and 9, in order to apply the present invention to a dual pump hydraulic system, the valve of FIG. 3 is provided with a T connection 45 having passages 46,47 connected by lines 48,49 to dual pumps 50,51 with common inlet and driven by common motor 52. A shuttle valve 53 in the form of a ball functions to apply to the discharge line 48,49 depending upon which of the discharge lines has the higher pressure. This applies the higher pressure to the unloading and vent valves. When both pumps circuits are decompressed the ball will center itself as shown in FIGS. 8 and 9 and provide passages for bypassing the cooling flow to both pumps when there is no load on either of the pumps.

By this arrangement it is possible to utilize a single valve system for dual pumps with common inlet and driven by the same motor.

What is claimed is:

1. A hydraulic system comprising
   - a pump having a discharge circuit,
   - a first valve in the inlet to the pump for restricting the flow into the pump when the first valve is closed,
   - a second valve,
   - a third valve in the discharge circuit for unloading the pump discharge circuit away from the pump inlet,
   - said second valve being operable to vent said third valve to tank pressure,
   - a motor for operating the first valve such that the pump inlet will be opened or be restricted and such that the second valve will open or be restricted to vent the third valve.

2. The hydraulic system set forth in claim 1 including means for diverting the increased pump discharge flow away from the second valve during the initial opening of the first valve to prevent the over pressurization at the second valve and facilitate the closing of the second valve by the motor.

3. The hydraulic system set forth in claim 1 wherein said motor, first valve and second valve are constructed and arranged such that said second valve is operable by said motor to open prior to the restricting of the first valve.

4. The hydraulic system set forth in claim 1 wherein the first valve restricts the pump inlet and admits a predetermined amount of fluid for lubricating and cooling the pump, and passage means is provided through the third valve and second valve for returning the flow back to the inlet to the pump.

5. The hydraulic system set forth in claim 1 wherein said first valve comprises a valve body adapted to be connected to a pump, said first valve having a valve element, said second valve comprising a second body mounted on said first valve body, said motor comprising a body mounted on said second valve body and having an element connected to said valve element for operating said valve element of said first valve, said second valve comprising tubular element mounted on said second valve and that adapted to be moved by said valve element of said first body to prevent flow to said second valve, means yieldingly urging said third valve into position where it is not vented.

6. The hydraulic system set forth in claim 5 including means yieldingly urging said tubular element against said valve element such that when the motor is operated to move said valve element to open said first valve, the fluid is permitted to flow from said third valve to tank.

7. The hydraulic system set forth in claim 1 including a second pump, means for sensing the discharge pressure of said first pump and second pump and applying the higher discharge pressure to the second and third valves.

8. The hydraulic system set forth in claim 7 wherein said third valve includes a valve body and a bore, a valve in said bore controlling the flow through said third valve to tank pressure and a restricted passage permitting fluid flow through said third valve to said second valve.

9. The hydraulic system set forth in claim 8 including a line connecting the second valve and the inlet to said first valve, said line being connected to tank pressure.

10. A hydraulic system comprising a pump having an inlet and an outlet, a first line from the outlet of the pump, a normally closed inlet valve having an inlet and outlet controlling flow from a source to the inlet of said pump, a normally closed unloading valve having an inlet connected to the first line and having an outlet, a second line connected to the outlet of said unloading valve, said unloading valve having means forming a restricted passage permitting flow from the first line to the second line, a normally open vent valve having an inlet connected to the second line and having an outlet, a third line extending from said outlet to said vent valve to the inlet valve, a motor for moving said vent valve and said inlet valve to open positions, said inlet valve having means for directing a predetermined amount of fluid to the inlet of the pump when the inlet valve is closed such that when the inlet valve is normally closed only said predetermined flow will occur for cooling and lubricating the pump and when there is no load on the system and the motor is operated to open the inlet valve, the inlet valve is opened and the vent valve is closed, the inlet valve, unloading valve and vent valve being constructed and arranged such that when there is a load on the hydraulic system and the motor is operated to open the inlet valve, the vent valve remains open before the inlet valve is completely opened providing communication between the unloading valve and tank pressure through the second line and the vent valve and thereby causing a pressure differential across the first line, the unloading valve and second line to open the unloading valve to discharge the flow from the first line to tank pressure until the inlet valve is fully open and the vent valve is closed.

11. The hydraulic apparatus set forth in claim 10 wherein said inlet valve having a common shaft, said inlet valve including a valve element associated with the outlet of said inlet valve and mounted on said common shaft, said vent valve comprising a tubular element spaced from said shaft defining a passage to the inlet to said inlet valve defining said third line, means yieldingly urging said tubular element toward said valve element such that when the valve element is open, the tubular element closes a passage to said third line, and when the valve element is partially closed, the tubular element opens a passage to said third line.

12. The hydraulic apparatus set forth in claim 11 wherein said unloading valve comprises a bore having a first end connected to said first line and a second end connected to said second line, a piston valve element in said bore, a tank passage in said body, said piston valve element controlling flow through said tank passage.

13. The hydraulic apparatus set forth in claim 11 wherein said means providing a restricted passage in said unloading valve comprises a restricted passage through the piston valve element.

14. The hydraulic apparatus set forth in claim 11 wherein said means providing a restricted passage in said inlet valve comprises a passage in said inlet valve body extending between opposite ends of said piston valve element.

* * * * *